US006877218B2

(12) United States Patent
Perea, Jr. et al.

(10) Patent No.: US 6,877,218 B2
(45) Date of Patent: Apr. 12, 2005

(54) HAND TOOL FOR APPLYING ELECTRICAL CONNECTORS

(75) Inventors: Levi J. Perea, Jr., Chicago, IL (US); Steve Grabowski, Chicago, IL (US)

(73) Assignee: Rauland-Borg Corporation, Skokie, IL (US)

( * ) Notice: Subject to any disclaimer, the term of this patent is extended or adjusted under 35 U.S.C. 154(b) by 524 days.

(21) Appl. No.: 09/886,887

(22) Filed: Jun. 21, 2001

(65) Prior Publication Data

US 2002/0194725 A1 Dec. 26, 2002

(51) Int. Cl.[7] ..... H01R 43/04

(52) U.S. Cl. ..... 29/749; 29/751; 29/753; 29/755

(58) Field of Search ..... 29/749, 751, 753, 29/758, 257, 564.1, 760, 861; 7/107; 72/409.14, 409.08

(56) References Cited

U.S. PATENT DOCUMENTS 4,074,424 A 2/1978 Deshich et al.
4,144,633 A * 3/1979 Tucci ..... 29/566.3
4,349,944 A * 9/1982 Fickes ..... 29/566.4
4,520,558 A * 6/1985 Bunnell ..... 29/749
5,222,292 A 6/1993 Comerci et al.
5,304,074 A 4/1994 Andre et al.
5,306,177 A 4/1994 Burke et al.
5,356,318 A 10/1994 Fry et al.
5,586,905 A 12/1996 Marshall et al.
5,659,948 A 8/1997 Vanderhoof et al.
5,996,224 A * 12/1999 Sullivan ..... 29/863
6,105,229 A 8/2000 Sullivan
6,161,278 A 12/2000 Easter et al.
6,165,003 A 12/2000 Bigotto

* cited by examiner

*Primary Examiner*—Minh Trinh
(74) *Attorney, Agent, or Firm*—Chapman and Cutler LLP

(57) ABSTRACT

A lightweight, portable hand tool is provided for applying an insulation-piercing electrical connector, having insulation displacement conductive elements, to an insulated electrical cable. The tool is made of injection molded, impact resistant plastic and includes a manually grippable frame, with a loading die on the frame for receiving and holding the insulation-piercing electrical connector. A manually actuable, movable portion of the frame moves relative to electrical connector to cause the insulation on the wires to be pierced and thereby electrically connected to the connector. The tool is suitable for use with electrical cable having one or more pairs of wire, such as the typical four pair Ethernet cable.

4 Claims, 2 Drawing Sheets

HAND TOOL FOR APPLYING ELECTRICAL CONNECTORS

BACKGROUND OF THE INVENTION

1. Field of the Invention

This invention generally relates to the wiring in electronic systems and, in particular, to a rugged, portable, lightweight, inexpensive, hand tool for connecting a multi-wire electrical cable to an insulation-piercing connector in the field.

2. Description of the Related Art

There are a wide variety of hand tools available for performing a connection of an electrical cable to a connector, such as the familiar modular registered jack connector (RJ) of a telephone connection interface or insulation-piercing connector, examples of which are described in U.S. Pat. Nos. 5,304,074, and 5,306,177. It is a general practice to remove the outer jacket from the end of a cable and to place a connector into the tool. The individual wires are then inserted, one at a time into a terminating tool and crimped before indexing to the next wire. In telephone systems, the wires are typically color coded as a red and green pair and a black and yellow pair, respectively. The red and green pair of telephone lines usually carry voice or data. On an outside telephone company connection, the black and yellow pair can be used for low voltage signals, such as phone lights.

After all of the wires have been crimped, the connector is removed and pushed into the housing by hand. Such practice makes termination by the use of hand tools very cumbersome and time consuming. The technician making the connection must take care to know the proper wire order to avoid mixed/crossed pairs.

The wire insertion process may not be difficult for experienced wire handlers and technicians, who work with the wire bundles and connectors everyday. However, for less experienced users, the manual use of such a hand tool can be very difficult. Prior hand tools used for applying the connectors have also generally been large, awkward, heavy and expensive.

One of the most common types of hand tools of the character described is of a pliers-type tool for effecting a scissors-type motion between a pair of pivotally connected handles. A problem with such pliers-type tools is that they either operate with their closing jaws or dies moving in arcuate paths versus linear paths or complicated toggle arrangements are used which require numerous parts to convert the arcuate movement of the scissors-type handles to linear movement of the jaws. Other non-pliers type hand tools are available but those tools, again, employ an excess number of parts, are excessively bulky and are not easily handled. An example of one type of tool is shown in U.S. Pat. No. 5,222,292.

There is a need for a simple, portable lightweight hand tool for applying an electrical connector, the jaws or dies of the tool operating in a linear path, and which is simple to operate and/or manipulate. An example of such a need is in the area of terminating or applying cable which include a plurality of individually insulated electrically conductive wires, such as of plastic material. In terminating such cable, a hand tool must apply uniform linear forces between opposing jaws or dies of the tool because of the substantial planar area of the cable to be terminated, i.e. in comparison to terminating a single or discrete wire. Of course, the invention is applicable to a variety of electrical cables wherein the advantages of the invention are of significance.

Often, unshielded twisted pair cabling is used in Ethernet and communication applications. The wires may be connected to a interface card, as is well known to those skilled in the art. Any number of wires may be used but typically, four, six, eight wires may be used in a application of this type. In addition, a color coding scheme is often used. For example, a solid and striped wire color scheme is common, such as white/blue and blue/white, white/orange and orange/white, white/green and green/white and white/brown and brown/white. The solid and striped color combinations are used to determine which pairs of wires must be twisted together in a specific sequence to provide adequate signaling. For example, the wires would be connected to various pins and receiving slots in the jack depending on the end use application. For example, an Ethernet 10 base-T connection could use pins 1 and 2 and 3 and 6, while a communication applications could use pins 4 and 5 and 3 and 6.

SUMMARY OF THE INVENTION

It is therefore an object of the present invention to provide a method of simply and efficiently inserting wires into a multiple position insulation-piercing connector.

Another object of the invention is to provide a new and improved inexpensive, portable, lightweight hand tool designed to reduce wiring errors when applying an insulation-piercing connector having insulation displacement conductive elements on the end of an insulated electrical cable.

In the exemplary embodiment of the invention, the hand tool includes a two-part manually grippable frame. A location is provided on one part of the frame for receiving and holding the insulation-piercing connector. The second part of the frame is movable relative to the first for engagement with the electrical connector. Generally, the pressure is manually applied between the two parts of the frame, whereupon pressure is exerted on the insulation-piercing electrical connector. In this way, the tool is easy to use and can easily be operated by one person during an installation, when up on a ladder, for example.

Another object of the invention is to provide method of connecting color coded wires in a multiple position, insulation-piercing modular connector of a communication system. Individual wires that have been exposed by stripping the outer insulator covering from the end of a cable are arranged by color in the hand tool which has a wire insertion end and grooves on a top surface that are also color coded in an order representing the order in which the ends of the color coded wires are to be placed into the insulation-piercing connector. The grooves are dimensioned to receive in a frictional fit the respective color coded wires of the electrical cable. The hand tool is moved manually into position such that the ends of the wires extend into and are aligned with conductive elements and associated teeth that pierce the insulation on the wire.

Another feature of the invention is the provision of a manually grippable handle on the frame. In the preferred embodiment of the invention, the manually grippable elements take the shape of a plurality for "finger" receivers on one portion for the frame and a "hand" or "thumb" contacting element on the other portion of the frame.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims.

The invention, together with its objects and the advantages thereof, may be best understood by reference to the following description taken in conjunction with the accompanying drawings in which like reference numerals identify like elements in the figures and in which.

DETAILED DESCRIPTION OF THE PREFERRED EMBODIMENT

Figure 1:
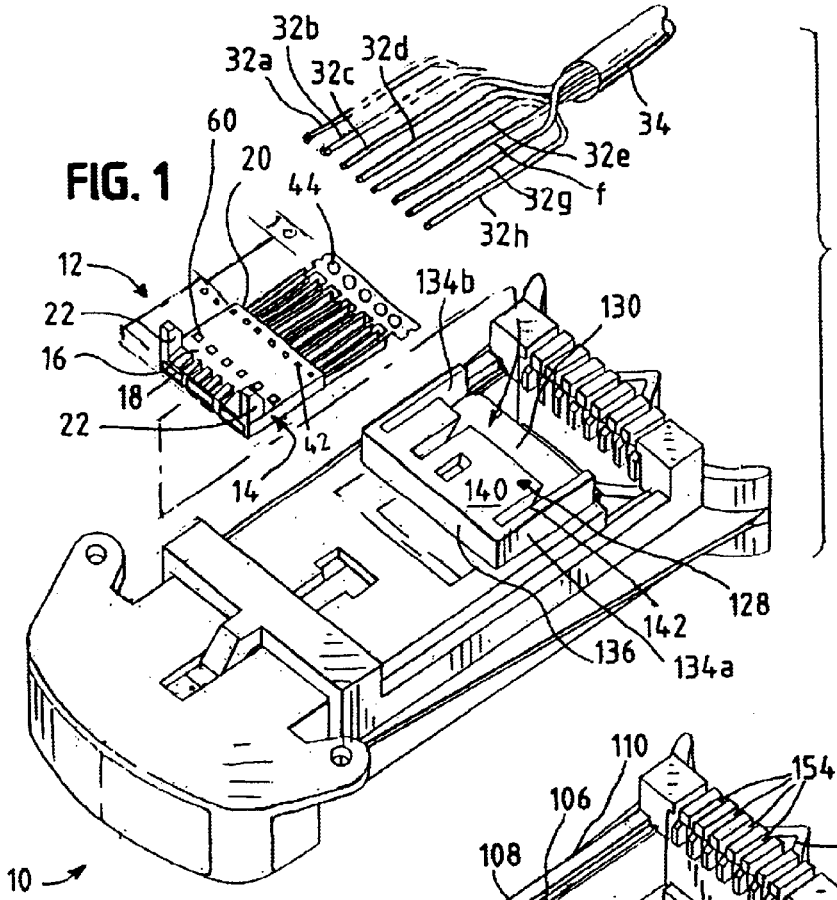
FIG. 1 is a an exploded perspective view of an electrical wire, insulating piercing connector and the hand tool made in accordance with the present invention.

Referring to the drawings in greater detail, the invention is disclosed in a portable lightweight hand tool generally designated 10, for applying an insulation-piercing electrical connector, generally designated 12. Although the insulation-piercing connector itself is available in the market place and does not comprise a part of the invention, for a complete understanding of the invention it is important to understand the details of insulation-piercing connectors that the invention is intended to be used with.

For instance, a first part, generally designated 14, of the insulation-piercing connector comprises an insulated, generally rectangular housing 16. The housing 16 is generally made of non-conducting rigid plastic. The plastic housing 16 has an interface end 18 and a wire connecting end 20 as will be more fully described hereinafter. The insulating end 18 may include a plurality of upstanding tabs 22 which may serve to align the connector when connected to or assembled with the interfaced joint installation. Typically the interface end is frictionally pressed onto a plurality of pins on a printed circuit board to complete the assembly and the electrical connection. Many types and designs for the insulating piercing connectors 12 are commercially available. The most commonly used types are those where 4 or more wires, often referred to as "two pairs" are used. In the drawings of FIG. 1, the connector 12 that is shown in solid lines is designed for a six wire cable, and the extension shown in phantom adds two wires which would be for an eight wire cable commonly used in Ethernet applications.

Figure 4:
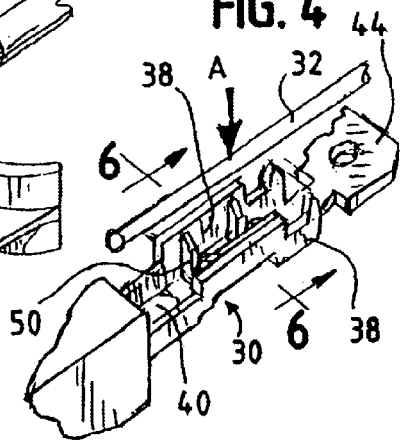
FIG. 4 is a very close up view of one of the insulated electrical wires prior to its insertion in one of the channels of the insulation piercing connector.

Referring to FIG. 4, the connector 12 has a metallic, conductive channel generally designated 30 that is used to connect each of the individual, insulated wires 32. At the top of FIG. 1, an electrical cable 34 is shown which includes eight individual wires 32*a*–32*h*, again sometimes referred to as four pair. The insulation piercing connector 12 will include four, six, eight or as many of the channels 30 that are desired. Each channel 30 has a pair of sidewalls 38 and a bottom wall 40 forming a generally upward directed U-shaped channel. The connector 12 is normally assembled and sold in what is referred to as the extended position shown in FIGS. 1 and 4 where a portion of each of the channels 30 extends into the plastic housing portion 14 of the wires 32, so they cannot be removed. Typically each channel 30 has an upstanding prong that extends into the openings 42 in the top surface of the housing 16. In addition, during the manufacture of the connector 12, the opposite distal ends of each of the channels 30 are connected by a perforated tab 44 to maintain the integrity of the assembly prior to connection to the wires 32.

The insulation piercing connectors operate as follows to connect the wires 32 to the connector. Each wire 32 is manually inserted through the top, open side of each channel 30 where it will engage one or more spaced piercing elements 50 that are generally U-shaped and open at the top with a pair of sharpened edges 52. The angled, sharp edges 52 serve to "pierce" or displace the insulation 54, shown in solid, on each wire 32 as it is moved downwardly in the direction of Arrow A shown in FIGS. 4 and 6 when nested within the channel 30.

Figure 3:
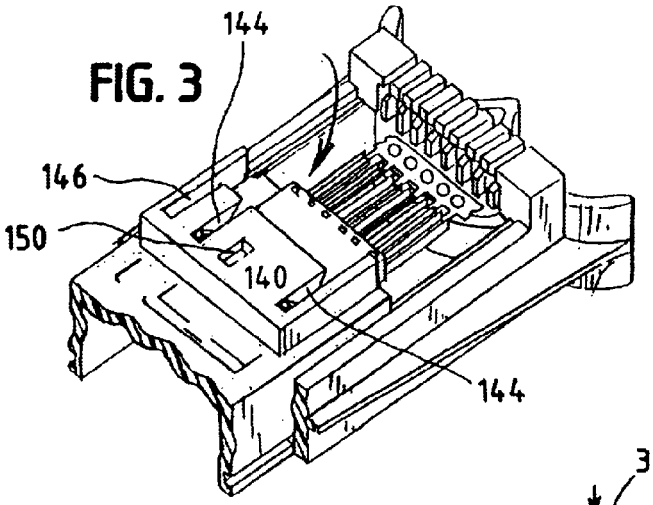
FIG. 3 is a close up view of the hand tool of the present invention with an electrical connector placed therein.
Figure 5:
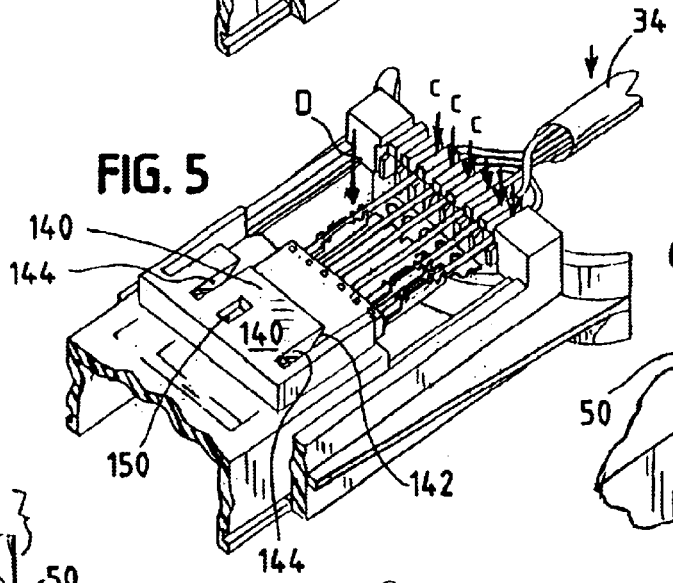
FIG. 5 is another perspective view of the hand tool as shown in FIG. 3 with a plurality of electric wires inserted in the grooves of the tool and the electrical connector.
Figure 7:
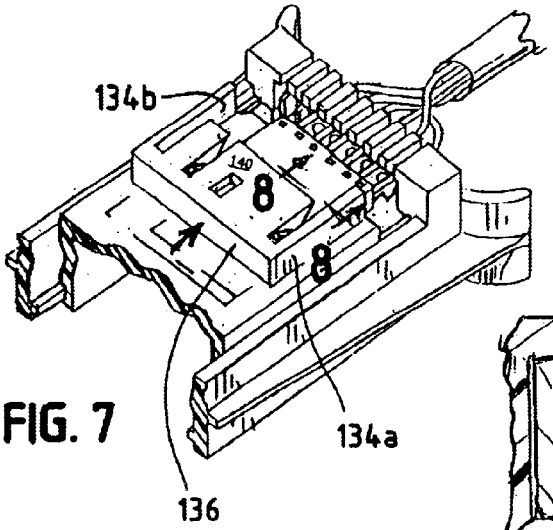
FIG. 7 is a close up of the hand tool and connector after the hand tool has been actuated.
Figure 8:
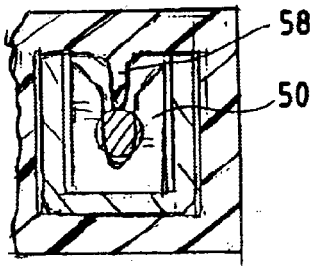
FIG. 8 is a sectional view of the connector after assembly by the hand tool of the present invention.

The nesting of the wires 32 within the channels 30 occurs as the connector 12 is compressed or collapsed from the position as shown in FIG. 3 to the position as shown in FIG. 7. Briefly, the connector 12 is inserted in the tool as shown in FIG. 3 with the channels 30 extended. The wires 32 are manually inserted into the channels 30 as shown in FIG. 5 and the connector 12 is compressed to the position shown in FIG. 7. Upon this compression or actuation of the hand tool, as will be more fully described in detail hereinafter, all of the channels 30 are moved inwardly into complementary openings within the housing 14 and as this occurs, the flat top 58, as show in FIG. 8, gradually pushes down on the upper surface of individual wires 32, forcing them against the cutting edges 52 which pierce the insulation 54 causing the conductive portion of the wire 32 to engage the cutting elements 50 that are integral with the channel 30 to provide a secure electrical connection therebetween. When the combination of channels 30 is fully inserted within the connector housing 14, the upstanding protruding elements, which provided a means for preventing disassembly of the channels by extending into the apertures 42, have moved forwardly and catch within the apertures 60 near the interface end 18 of the connector. The front or forward most ends of each of the channels are then adjacent the interface end of the connector and can receive the connection pins from the printed circuit board or other element to which the wire 34 is being connected. Therefore, as can be seen the connectors 12 can be used to simultaneously connect one or more wires 32 to a connector 12 for a subsequent connection to an interface. The final step in the connector assembly is to physically remove the perforated tab 44 from the rearward most, distal end of the connector channels 30 and discard it. This removal eliminates any electrical contact between any of the individual channels 30 which are now fully insulated from one another by the housing 14.

As described above in the Summary of the Invention, the primary purpose for the creation and design of the hand tool of the present invention is to provide a lightweight, inexpensive, easy-to-use hand tool for connecting electrical cables to insulation piercing connectors. In the past, very expensive hand tools costing upwards of $500 or so were required for use with these types of connectors. As will be explained in detail herein, the present invention provides an easy to use, two-piece, plastic injection molded hand tool 10 that can be economically manufactured so every installer can have one and so that wiring errors can be substantially reduced.

Figure 2:
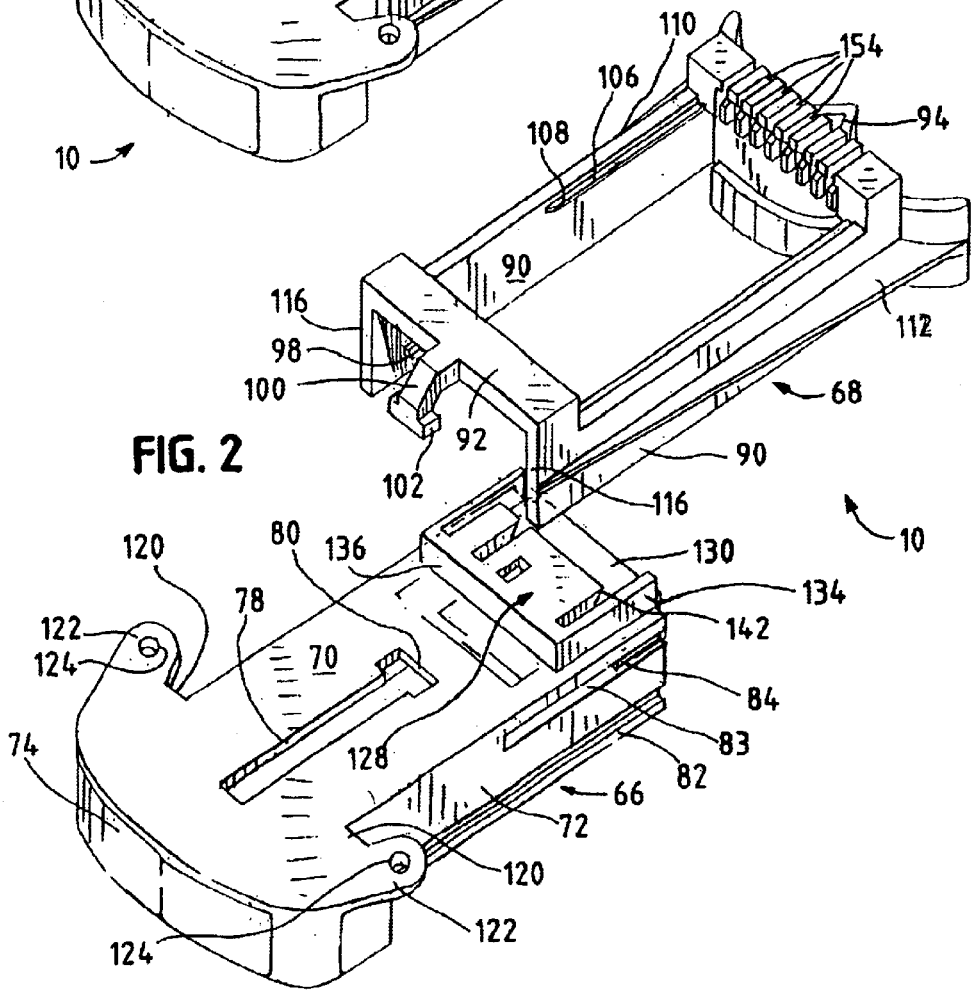
FIG. 2 is another, exploded perspective view of the hand tool made in accordance with the present invention.

Referring to FIGS. 1 and 2, the hand tool 10 of the present invention includes a two part, lightweight, injection molded plastic frame having a "palm" portion generally designated 66 and a "finger" portion 68. Each portion of the frame 66 and 68 is molded separately of sturdy, rigid, durable plastic in a conventional manner. After manufacture, the two portions are assembled as follows. The palm portion 66 of the frame has a generally U-shaped configuration with a top flat surface 70 and a pair of downwardly directed sidewalls 72. The top surface 70 has a generally flat surface near the proximate or "palm" contact end 74 which is designated as such since the arcuate surface 74 generally contacts the palm of the hand of the user when the tool is actuated. Near the proximate end of the frame element 66, a T-shaped slot 78 is provided with the enlarged "T" portion 80 generally near the center of the tool. The sidewalls 72 each include a pair of lower, longitudinal guide grooves 82 and a cam or detent means 84 which cooperate with the finger portion 68 of the frame as described below.

The finger portion 68 of the frame includes a generally open, rectangular structure having a pair of generally vertical sidewalls 90, a forward crossbar 92 and a rear "finger gripping element" 94, which is molded in two generally arcuate sections for engaging two fingers of the hand of the user during actuation. Each of the sidewalls 90 includes an inwardly directed slide protrusion 98 which engages the groove 82 on the palm portion 66 of the frame when assembled.

A forwardly, downwardly depending key 100 is formed on the crossbar 92, and carries a crossbar 102 on its lower end. Crossbar 102 is inserted within the T-shaped end 80 of the T-shaped slot 78 within the upper surface 70 of the palm portion of the frame at assembly. After the key is inserted in the T-shaped slot 78, the finger portion of the frame 68 is aligned so that the guide protrusions 98 fit within the guide slots 82 on the sidewalls 72 of the palm portion of the frame. The protrusions 98 assist in maintaining alignment and permit the finger frame portion to move or slide toward the palm end of the palm portion 68 until the key 100 engages the end of the slot 78. The detent means 84, in the form of a cam surface 106 on the upper end of each of the sidewalls 90 prevent the two parts of the tool from being inadvertently disassembled by the casual user. The cam surface 106 extends through only about 25% of the length of the sidewall 90 and cooperates with a similar protrusion 84 to prevent disassembly. The cam element 106 is inserted on each side within the upper guide slot 83 and, as the tool is compressed for the first time, the cam surfaces 108 on the front end thereof engage and override the protrusions 84 to spread the sidewalls 90 of the finger portion of the frame slightly until the rear end 110 passes the forward end of the small protrusion 84. At that time the protrusion 106 fits snugly within the upper guide groove 63 and permits forward movement therein while assisting in the maintenance of the alignment between the palm and finger portions of the frame. However, unlike the front caming surface 108 of the protrusion 106, the rearward end 110 is essentially square so that upon movement of the frame elements in the opposite direction, the surface 110 engages the front surface of the protrusion 84 and prevents disassembly of the two parts of the frame.

For extra rigidity and strength, a pair of triangular reinforcing elements 112 are provided along the outer length of each wall 90 of the finger portion 68 of the frame and terminate in a fused fashion with the arcuate extending portion of the finger elements 94 to provide an aesthetic and pleasing looking tool design. Also, as the tool is compressed the front, vertical surfaces or edges of the sidewalls 90 engage and abut vertical surfaces 120 to permit further relative travel of the palm and finger portions of the frame. A pair of tabs 122 at the proximate end of the palm portion 66 each include an aperture 124 that can be connected to a tether or key chain.

Referring now to FIGS. 1 and 3, the palm portion 68 includes a connector locator or die 128 at its distal end. The die 128 may be of various shapes and holds the connector 12 for complete assembly as described herein. The die 128 includes a lower support surface 130 on the palm portion 66, generally in the same plane as the surface 70. The support surface 130 may be contiguous or open and if open, includes a tab or support surface 132 for the interface end of the connector 12 opposite the distal end of the support surface 130. The die includes a pair of parallel upstanding walls 134*a* and 134*b* and an end wall 136 for securely contacting the housing portion 14 of the connector being used. In the preferred embodiment, one of standing walls 134*b* is spaced from the other to accommodate the use of a tool for an insulation piercing connector of the type described wherein eight wires are simultaneously electrically connected to the connector 12. In the particular embodiment shown in the drawings, the die includes an upper, rearwardly extending cantilever wall 140 which extends from the vertical wall 136 rearwardly toward the distal end of the palm portion 66 of the frame. The distal end includes a chamferred or angled lower surface 142 which facilitates insertion of the connector housing 14 under the wall 140 and one or more depending ridges may be provided to securely locate and maintain the connector housing 14 within the die in a spring-like, friction fit. Therefore, when the connector is inserted into the die as shown in FIG. 3, the interface end 18 is inserted under the angular surface 142 of the cantilevered wall 140 which securely locates the connector housing 14 in the die. In the particular embodiment shown in the enclosed drawings, a pair of slots 144 are provided in the wall 140 to receive the upstanding tabs 22 of the particular connector 12 shown in the drawings. Of course, various configurations of the top wall 40 could be made to accommodate various types of connectors 12 without departing from the spirit and scope of the present invention. Again, the particular connector 12 shown in the drawings is designed for connecting six wires 32 to a cable 34, and the wall 134*b* is spaced therefrom to provide additional space for use with a similar connector adapted to connect eight electrical wires 32. An additional slot 146 may be provided in the wall 140 in the situation where an eight wire connector includes an upstanding tab 22 at the end adjacent the wall 134. Another aperture 150 may be provided for other purposes, such as to permit visual inspection of the housing 14 within the die 128.

The distal end of the finger portion of the frame 68 includes a plurality of troughs or wire grooves 154 at its distal end forming a "comb" to facilitate alignment of the individual wires 32*a*–32*h* for connection to the connector 12. The individual grooves carry indicia and are color coded so as to assist the user in selecting and aligning the wires 32*a*–32*h*. For example, in FIG. 1 the individual 8 wires are identified as 32*a*–32*h*. In a typical installation, the wires may be color coded, generally from left to right as shown in FIG. 1, as follows:

32*a*—brown/white
32*b*—white/brown
32*c*—green/white
32*d*—white/green
32*e*—orange/white

32*f*—white/orange

32*g*—blue/white

32*h*—white/blue

Obviously, other color combinations are possible, but in the preferred embodiment each of the grooves 32*a* through 32*h* would bear indicia indicating the color of the wire insulation 54 to be inserted and extended through the appropriate groove 154. The width of each groove 154 is designed to comfortably, frictionally receive and retain the individually insulated wires 32*a* through 32*h*.

Figure 6:
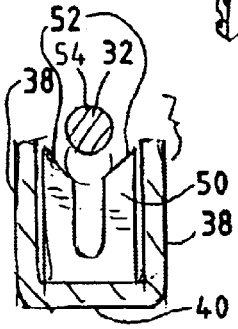
FIG. 6 is a cross section of one channel and the wire taken generally along line 66 of FIG. 4.

The use of the hand tool of the present invention to connect multiple wires of an electrical cable 34 can be seen in the sequences shown in FIGS. 1, 3, 5 and 7. In particular, the outer insulation of the cable 34 is stripped so that the individual inner, insulated wires 32*a* through 32*h* extend outwardly from the end of the outer insulation 34 and can be aligned in a planar arrangement, as shown in the exploded view of FIG. 1. In the case where six wires 32 are to be connected to a connector 12, the connector 12 is first inserted into the die location 128 of the palm portion 66 of the frame in its expanded position. In the preferred embodiment, the inside vertical wall of the groove forming surfaces are designed with a horizontal, V-shaped groove for receiving the perforated tab 44 of the connector 12 when the hand tool is actuated. The next step in the operation of the hand tool is shown in FIG. 5, where the free ends of each wire 32 is inserted into the aligned metallic channel 30 of the connector by manually depressing them into the upper opening of each channel as shown by the arrow "D" in FIG. 5, then the six wires 32 are inserted within the grooves 154 of the finger portion of the frame by manually inserting and pushing them downwardly in the direction of the arrows "C" shown in FIG. 5. Care must be taken to insure that the color coding of the wires follows the indicia on each groove 154 so that the order of insertion of the wires 32 within the channels 30 of the connector follows the intended order. The manual insertion of the wires 32 into the channels 30 of the connector normally does not cause the insulation to be pierced, but relies on friction and the general rigidity of the electrical wire itself to hold them in a position and engagement with the cutting edges 52 as shown in FIG. 6.

The final step in electrically connecting the individual wires 32 to the connector 12 is shown in the completed final position of the frame portions 66 and 68 as shown in FIG. 7. As described above, in FIG. 5, the wire elements 32 are in position within the channels 30, but the wires are not yet in electrical contact with the channels because the insulation has not yet been pierced. However, the user, by grasping the tool between the palm and finger portions when in the configuration as shown in FIG. 5, with the channels 30 in their fully extended position, actuates the tool. Compressing the tool and thereby sliding the palm portion 66 together with the finger portion 68 actuates the tool in the preferred manner. Upon actuation, the perforated tab 44 of the connector engages the inner wall of the grooves within the horizontal V-shaped groove which prevents further movement of the perforated tab 44 and the channels 30 relative to the finger portion 68 of the frame. Further compression drives the channels into the plastic housing 14 of the connector as previously described, and the inner, flat surfaces 58 within the housing simultaneously drives all of the insulated wires 32 downwardly into engagement with the cutting or piercing canted surfaces 52 to simultaneously pierce the insulation of all of the wires 32 bringing them into electrical contact with the spaced piercing elements 50 thereby creating an electrical connection between each of the individual wires and its associated channel 30. When the tool is completely compressed, the channels will have been pushed completely into the housing 14 and the spring tabs thereon into engagement with the apertures 60 to prevent outward movement of the channels relative to the housing 16. Thereafter, the electrical cable 34 is lifted to disengage each of the individual wires 32 from the grooves 154 in the finger portion 68 and a minimal force applied thereto causes the housing portion 14 to be released from the die 128 for a completed electrical connector. In this manner, each of the individual wires has been electrically connected to its associated channel and the color coded order as individual by the indicia shown on each of the grooves 154. The final step in completing the assembly and connection of the insulation piercing connector is to remove the perforated tab 44 at the distal end of all the channels 30 thereby eliminating any electrical connection between the adjacent channels and providing a final, assembled connector. As described previously, the connection point between the channels 30 and the perforated tab 44 may be scored to facilitate removal thereof after assembly.

It can be seen from the foregoing detailed description that many alterations and modifications of the present invention can be made by those skilled in the art without departing from the spirit and scope of the present invention.

We claim:

1. A portable lightweight hand tool for applying an insulation-piercing electrical connector to an insulated electrical cable having a plurality of wires, comprising:

a two part frame manufactured of impact resistant material;

the first part of said frame having loading die far receiving and holding the electrical connector, the loading die comprising at least two upstanding walls for engaging respective sides of the insulation-piercing connector; and the second part of the frame having a wire insertion end including a plurality of grooves for receiving the wires to be placed into the connector, whereby, when said first part is loaded with a connector and said grooves of said second part are loaded with wires, relative movement of the first and second parts of the frame causes insulation of the wires to be pierced and electrically connected to the connector.

2. A portable lightweight hand tool for applying an insulation-piercing electrical connector to an insulated electrical cable having a plurality of wires, comprising:

a two part frame manufactured of impact resistant material;

the first part of said frame having loading die for receiving and holding the electrical connector, the loading die on the frame comprising a plurality of grooves for accepting upstanding tabs on an insulation-piercing connector; and the second part of the frame having a wire insertion end including a plurality of grooves for receiving the wires to be placed into the connector, whereby, when said first part is loaded with a connector and said grooves of said second part are loaded with wires, relative movement of the first and second parts of the frame causes insulation of the wires to be pierced and electrically connected to the connector.

3. A portable lightweight hand tool for applying an insulation-piercing electrical connector to an insulated electrical cable having a plurality of wires, comprising:

a two part frame manufactured of impact resistant material;

the first part of said frame having loading die for receiving and holding the electrical connector; and the second part of the frame having a wire insertion end including a plurality of grooves for receiving the wires to be placed into the connector, whereby, when said first part is loaded with a connector and said grooves of said second part are loaded with wires, relative movement of the first and second parts of the frame causes insulation of the wires to be pierced and electrically connected to the connector, and wherein the first and second parts of the frame include detent means permitting initial assembly of the separate parts of the frame while preventing subsequent disassembly thereof.

4. The portable lightweight hand tool of claim 3 including a key and guideway formed on the respective parts of the frame to maintain alignment thereof during actuation.

* * * * *